US008650667B2

(12) United States Patent
Tominaga et al.

(10) Patent No.: US 8,650,667 B2
(45) Date of Patent: Feb. 18, 2014

(54) SWIMMING GOGGLES

(75) Inventors: Hirofumi Tominaga, Osaka (JP); Shinichi Hadehara, Osaka (JP)

(73) Assignee: Yamamoto Kagaku Co., Ltd., Osaka (JP)

( * ) Notice: Subject to any disclaimer, the term of this patent is extended or adjusted under 35 U.S.C. 154(b) by 233 days.

(21) Appl. No.: 12/905,784

(22) Filed: Oct. 15, 2010

(65) Prior Publication Data

US 2011/0088150 A1 Apr. 21, 2011

(30) Foreign Application Priority Data

Oct. 19, 2009 (JP) ..... 2009-240451

(51) Int. Cl.
*A61F 9/02* (2006.01)

(52) U.S. Cl.
USPC ..... 2/440; 2/442; 2/444; 2/445; 2/450

(58) Field of Classification Search
USPC ..... 2/440, 442, 444, 445, 450
See application file for complete search history.

(56) References Cited

U.S. PATENT DOCUMENTS

| | | | | |
|---|---|---|---|---|
| 6,321,390 | B1 | 11/2001 | Chiang | |
| 7,900,280 | B2 * | 3/2011 | Thorpe et al. | 2/428 |
| 2005/0120468 | A1 * | 6/2005 | Kawashima et al. | 2/444 |
| 2005/0241051 | A1 * | 11/2005 | Matsumoto et al. | 2/426 |

FOREIGN PATENT DOCUMENTS

| | | | |
|---|---|---|---|
| CA | 2123375 | A1 | 11/1995 |
| JP | 06-48715 | A | 7/1994 |
| JP | 3075386 | U | 11/2000 |
| JP | 2007143762 | A | 6/2007 |

OTHER PUBLICATIONS

European Search Report of 10187363.6-2318, dated Feb. 15, 2011.
Application for Canadian Patent, application No. 2,123,375, entitled Intra-Orbital Swim Goggles, filed on Feb. 25, 2011.
Office Action dated Aug. 27, 2013 for corresponding Japanese application No. 2009-240451.

* cited by examiner

*Primary Examiner* — Alissa Tompkins
(74) *Attorney, Agent, or Firm* — Heslin Rothenberg Farley & Mesiti P.C.

(57) ABSTRACT

Swimming goggles includes goggle bodies and face-contact pads. Each face-contact pad is mounted to the goggle body wherein an upper bottom surface and a lower bottom surface, respectively being in contact with positions above and below each eye of a wearer, are asymmetrically formed, and a distance from a lens front surface of the goggle body and an extension surface of the lens front surface to the lower bottom surface is greater than a distance from the lens front surface and the extension surface to the upper bottom surface. The swimming goggles does not leave un-wanted mark of the face-contact pad around the eyes of the wearer, a wearer does not feel uncomfortable, and water does not enter inside the goggles even when a high water pressure is applied at the time of diving or the like.

9 Claims, 14 Drawing Sheets

SWIMMING GOGGLES

CROSS REFERENCE TO RELATED APPLICATION

This application claims priority of Japanese patent application No. 2009-240451 filed on Oct. 19, 2009, the entire contents of which is hereby incorporated herein by reference.

BACKGROUND OF THE INVENTION

1. Field of the Invention

The present invention relates to swimming goggles including goggle bodies of eyecup shape or the like, and ring-shaped face-contact pads mounted to the goggle bodies.

2. Description of the Related Art

Examples of these types of conventional swimming goggles are disclosed in Patent Literatures 1 (Japanese Utility Model Laid-Open No. 06-48715) and 2 (Japanese Patent Laid-Open No. 2007-143762) as shown in FIGS. 10 to 14.

As shown in FIGS. 10 and 11, in an eyecup C of the swimming goggles disclosed in Patent Literature 1 and Patent Literature 2, an upper bottom surface 21*a* in contact with an upper mounting surface of a face-contact pad P mounted to the eyecup C, and a lower bottom surface 21*b* in contact with a lower mounting surface of the face-contact pad P are symmetrically formed. A distance from a lens front surface f to the upper bottom surface 21*a* of the eyecup C is the same as a distance from the lens front surface f to the lower bottom surface 21*b* of the eyecup C.

As shown in FIGS. 12 and 13, in the face-contact pad P mounted to the eyecup C, an upper bottom surface 31*a* in contact with a position above each eye of a wearer, and a lower bottom surface 31*b* in contact with a position below the eye of the wearer are symmetrically formed. A distance from the lens front surface f of the eyecup C to the upper bottom surface 31*a* is the same as a distance from the lens front surface f of the eyecup C to the lower bottom surface 31*b*.

In the conventional swimming goggles, the upper bottom surface 31*a* of the face-contact pad P contacts the position above each eye of a wearer, that is, a portion between the eyebrow and the upper lid, and the lower bottom surface 31*b* of the face-contact pad P contacts the position below the eye of the wearer, that is, a portion slightly below the lower lid. The portion between the eyebrow and the upper lid protrudes frontward from the portion slightly below the lower lid, and has a harder fitting and is thus less depressed when pushed as compared to the portion slightly below the lower lid.

Thus, when the wearer wears the conventional swimming goggles, a contact pressure at the portion between the eyebrow and the upper lid is larger than that at the portion slightly below the lower lid, and the portion between the eyebrow and the upper lid is strongly pressed by the upper bottom surface 31*a* of the face-contact pad P. Thus, there is a problem that the mark of the face-contact pad P clearly remains locally in the portion, or the wearer feels uncomfortable when wearing the goggles.

Furthermore, in the conventional swimming goggles, the portion between the eyebrow and the upper lid is strongly pressed by the upper bottom surface 31*a* of the face-contact pad P as described above. A pressing force on the portion slightly below the lower lid by the lower bottom surface 31*b* of the face-contact pad P is thereby correspondingly reduced. Thus, when a high water pressure is applied at the time of diving or the like, there occurs a problem that water may leak in the goggles from the portion.

SUMMARY OF THE INVENTION

Accordingly, the present invention has been made to solve the aforementioned conventional problems, and it is an object of the invention to provide swimming goggles where a clear mark of a face-contact pad does not remain locally, a wearer does not feel uncomfortable when wearing the goggles, and water does not leak in the goggles even when a high water pressure is applied at the time of diving or the like.

To this end, in swimming goggles according to the present invention, an upper connection surface of a goggle body in contact with an upper mounting surface of a face-contact pad mounted to the goggle body, and a lower connection surface of the goggle body in contact with a lower mounting surface of the face-contact pad are asymmetrically formed, and a distance from a lens front surface of the goggle body and an extension surface of the lens front surface to the lower connection surface is greater than a distance from the lens front surface of the goggle body and the extension surface of the lens front surface to the upper connection surface.

Also, in swimming goggles according to the present invention, an upper contact surface and a lower contact surface of a face-contact pad mounted to a goggle body, the upper contact surface and the lower contact surface respectively being in contact with positions above and below each eye of a wearer, are asymmetrically formed, and a distance from a lens front surface of the goggle body and an extension surface of the lens front surface to the lower contact surface is greater than a distance from the lens front surface of the goggle body and the extension surface of the lens front surface to the upper contact surface.

In the swimming goggles according to the present invention, an average value of a difference S1 to a difference S20 between the distance from the lens front surface of the goggle body and the extension surface of the lens front surface to the upper connection surface of the goggle body, and the distance from the lens front surface of the goggle body and the extension surface of the lens front surface to the lower connection surface of the goggle body at respective measurement positions Ma to Mt provided sequentially at equal intervals in a direction from an inner end portion to an outer end portion of the goggle body in the lens front surface of the goggle body and the extension surface of the lens front surface is set to 3.00 to 3.50 mm.

Furthermore, in the swimming goggles according to the present invention, an average value of a difference S21 to a difference S40 between the distance from the lens front surface of the goggle body and the extension surface of the lens front surface to the upper contact surface of the face-contact pad, and the distance from the lens front surface of the goggle body and the extension surface of the lens front surface to the lower contact surface of the face-contact pad at respective measurement positions Ma to Mt provided sequentially at equal intervals in the direction from the inner end portion to the outer end portion of the goggle body in the lens front surface of the goggle body and the extension surface of the lens front surface is set to 3.00 to 3.50 mm.

Also, in the swimming goggles according to the present invention, a value increases gradually from the difference S1 to the difference S6. A largest value is obtained at the difference S7 or the difference S8. A value decreases gradually from the difference S9 to the difference S20.

Furthermore, in the swimming goggles according to the present invention, an average value of the difference S1 to the difference S6 is set to 2.40 to 2.80 mm. The difference S7 or the difference S8 is set to 4.60 to 5.00 mm. An average value of the difference S9 to the difference S20 is set to 3.10 to 3.50 mm.

Also, in the swimming goggles according to the present invention, a value increases gradually from the difference S21 to the difference S26. A largest value is obtained at the difference S27 or the difference S28. A value decreases gradually from the difference S29 to the difference S40.

Furthermore, in the swimming goggles according to the present invention, an average value of the difference S21 to the difference S26 is set to 2.40 to 2.80 mm. The difference S27 or the difference S28 is set to 4.60 to 5.00 mm. An average value of the difference S29 to the difference S40 is set to 3.10 to 3.50 mm.

Since the swimming goggles according to the present invention are configured as described above, a clear mark of the face-contact pad does not remain locally, a wearer does not feel uncomfortable when wearing the goggles, and water does not leak in the goggles even when a high water pressure is applied at the time of diving or the like.

DETAILED DESCRIPTION OF THE PREFERRED EMBODIMENTS

Figure 1:
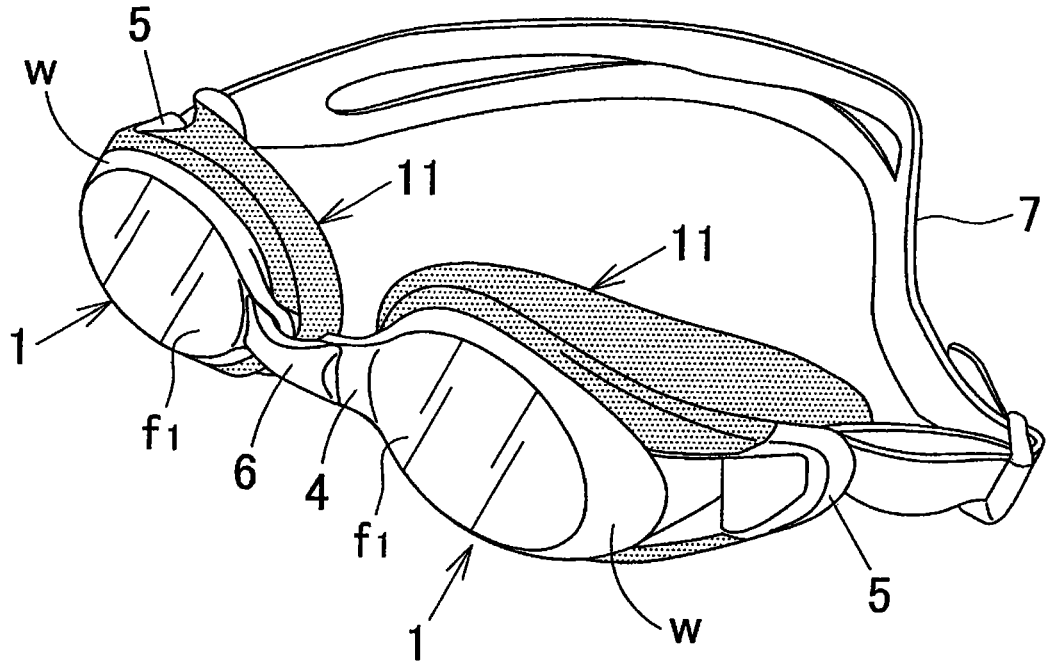
FIG. 1 is a perspective view of swimming goggles according to the present invention as viewed from the front side.
Figure 2:
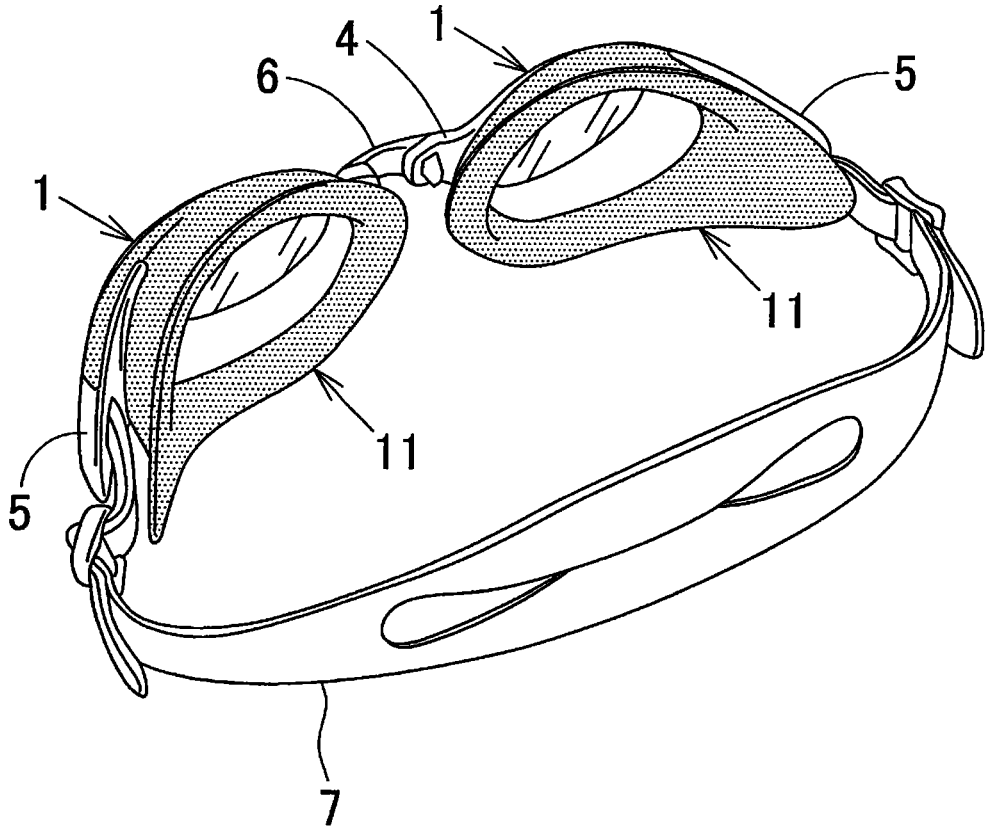
FIG. 2 is a perspective view of the swimming goggles according to the present invention as viewed from the rear side.

In the following, an embodiment for carrying out swimming goggles according to the present invention will be described in detail based on the drawings.

The swimming goggles according to the present invention include a pair of left and right (also referred to herein as first and second) goggle bodies 1 of eyecup shape or the like made of hard synthetic resin such as transparent or semi-transparent polycarbonate. Each of the goggle bodies 1 has a lens front surface f1, and a peripheral wall portion w extending backward from the rim of the lens front surface f1. A peripheral groove 2 is provided toward the inner side on the rear end side of the peripheral wall portion w, and a mounting flange 3 is provided so as to form a rear surface of the peripheral groove 2.

A bracket 4 is provided protruding from the peripheral wall portion w at an inner end portion of each of the goggle bodies 1. A belt mounting portion 5 is also provided protruding outward from the peripheral wall portion w at an outer end portion of each of the goggle bodies 1.

A flexible coupling body 6 is engaged with the brackets 4 to thereby couple the pair of first and second goggle bodies 1. Furthermore, opposite end portions of a stretchable fastening band 7 are respectively coupled to the belt mounting portions 5 such that the length can be adjusted.

A face-contact pad 11 made of soft synthetic resin such as elastic elastomer is mounted to the mounting flange 3 of each of the goggle bodies 1. The face-contact pad 11 includes a ring-shaped frame body 12 fitted onto the mounting flange 3, and a face-contact portion 14 formed integrally with the frame body 12 via a cushion peripheral wall 13 from the inner edge of the frame body 12. The face-contact portion 14 has a contact surface formed so as to contact a portion around each eye of a wearer. The face-contact pad 11 may be mounted to the goggle body 1 by fitting the frame body 12 onto the mounting flange 3, or by bonding the frame body 12 to the mounting flange 3.

In the face-contact pad 11, the cushion peripheral wall 13 is formed thin and spreading toward the open side from the inner edge of the frame body 12, and the thin spreading portion is formed wider toward the outer side such that the contact surface of the face-contact portion 14 contacts the portion around the eye of the wearer before the face-contact pad 11 is mounted to the goggle body 1.

Figure 3:
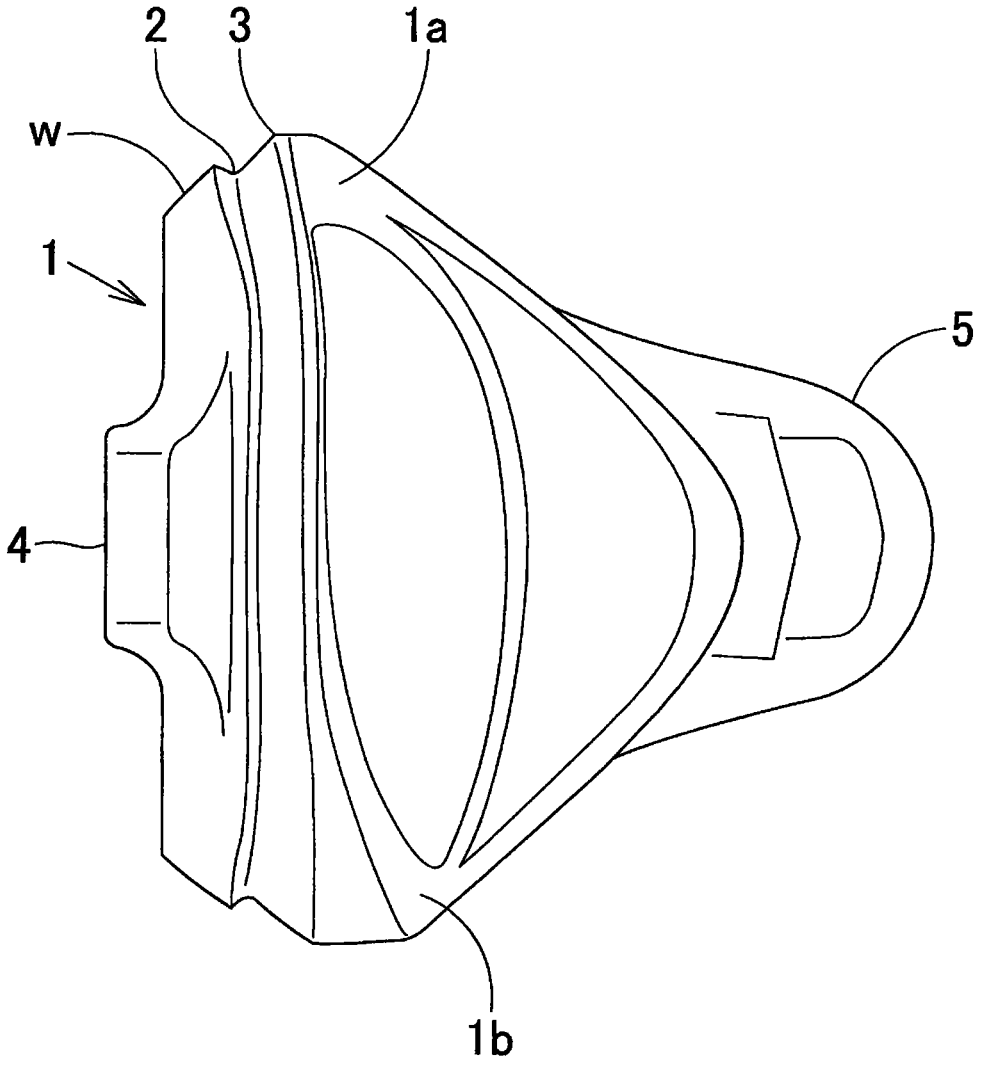
FIG. 3 is a side view of a goggle body of the swimming goggles according to the present invention to which a face-contact pad is not mounted.
Figure 4:
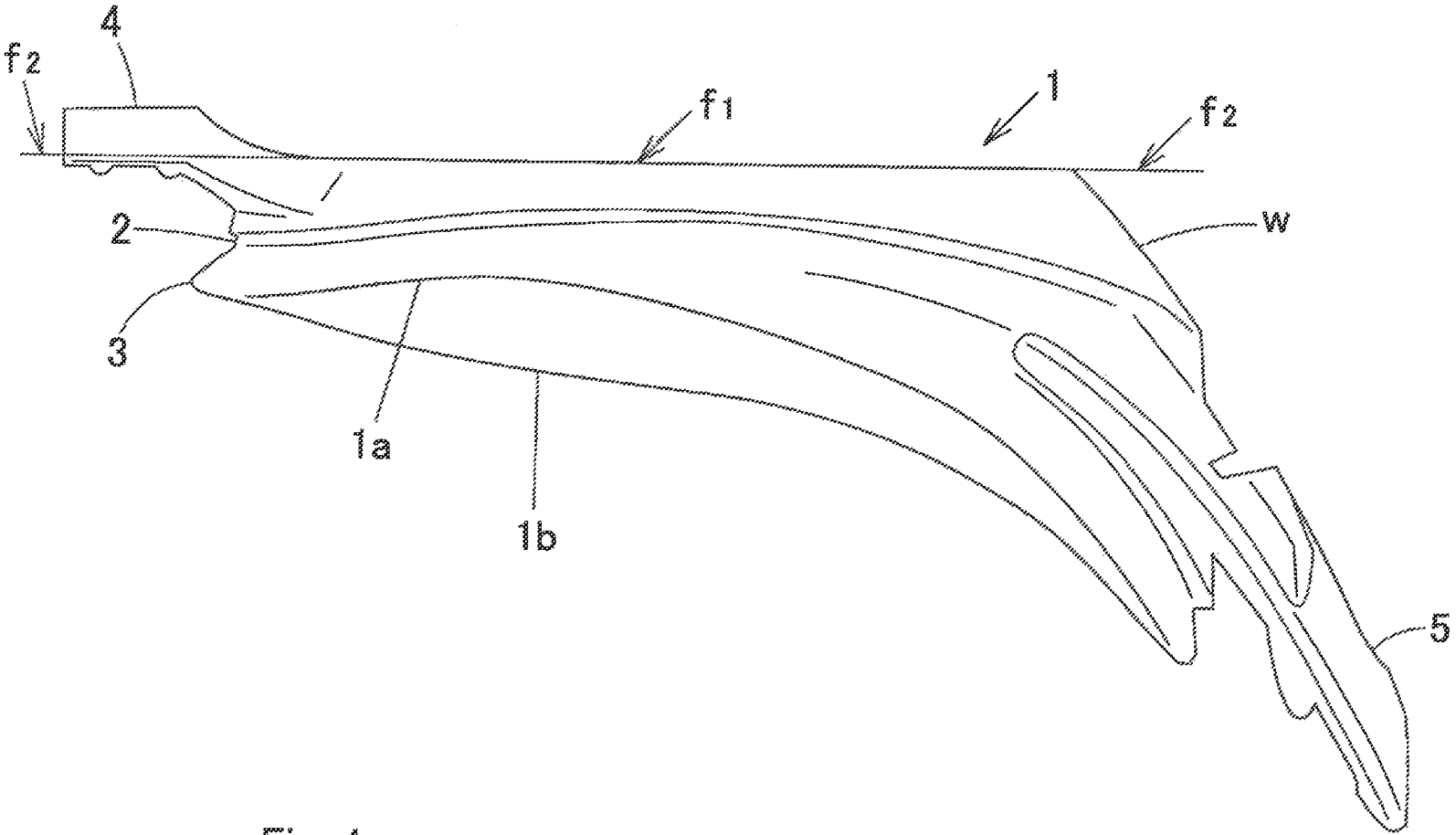
FIG. 4 is a plan view of the goggle body of the swimming goggles according to the present invention to which the face-contact pad is not mounted.

Furthermore, in the swimming goggles according to the present invention, an upper connection surface 1*a* in contact with an upper mounting surface of the face-contact pad 11 mounted to the goggle body 1, and a lower connection surface 1*b* in contact with a lower mounting surface of the face-contact pad 11 are asymmetrically formed as shown in FIGS. 3 and 4. An entire distance from the lens front surface f1 of the goggle body 1 and an extension surface f2 of the lens front surface f1 to the lower connection surface 1*b* is greater than an entire distance from the lens front surface f1 of the goggle body 1 and the extension surface f2 of the lens front surface f1 to the upper connection surface 1*a*.

Figure 6:
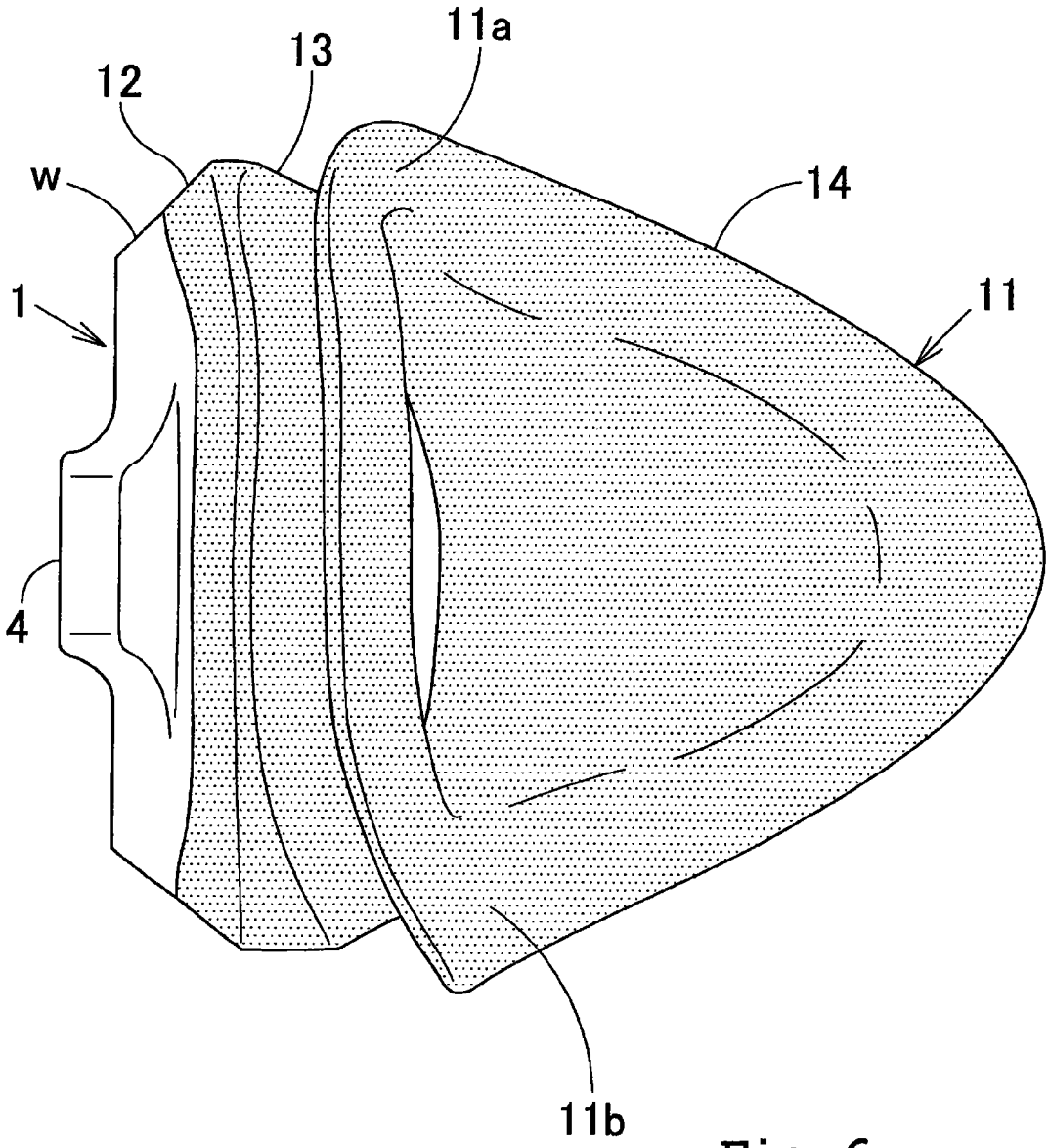
FIG. 6 is a side view of the goggle body of the swimming goggles according to the present invention to which the face-contact pad is mounted.
Figure 7:
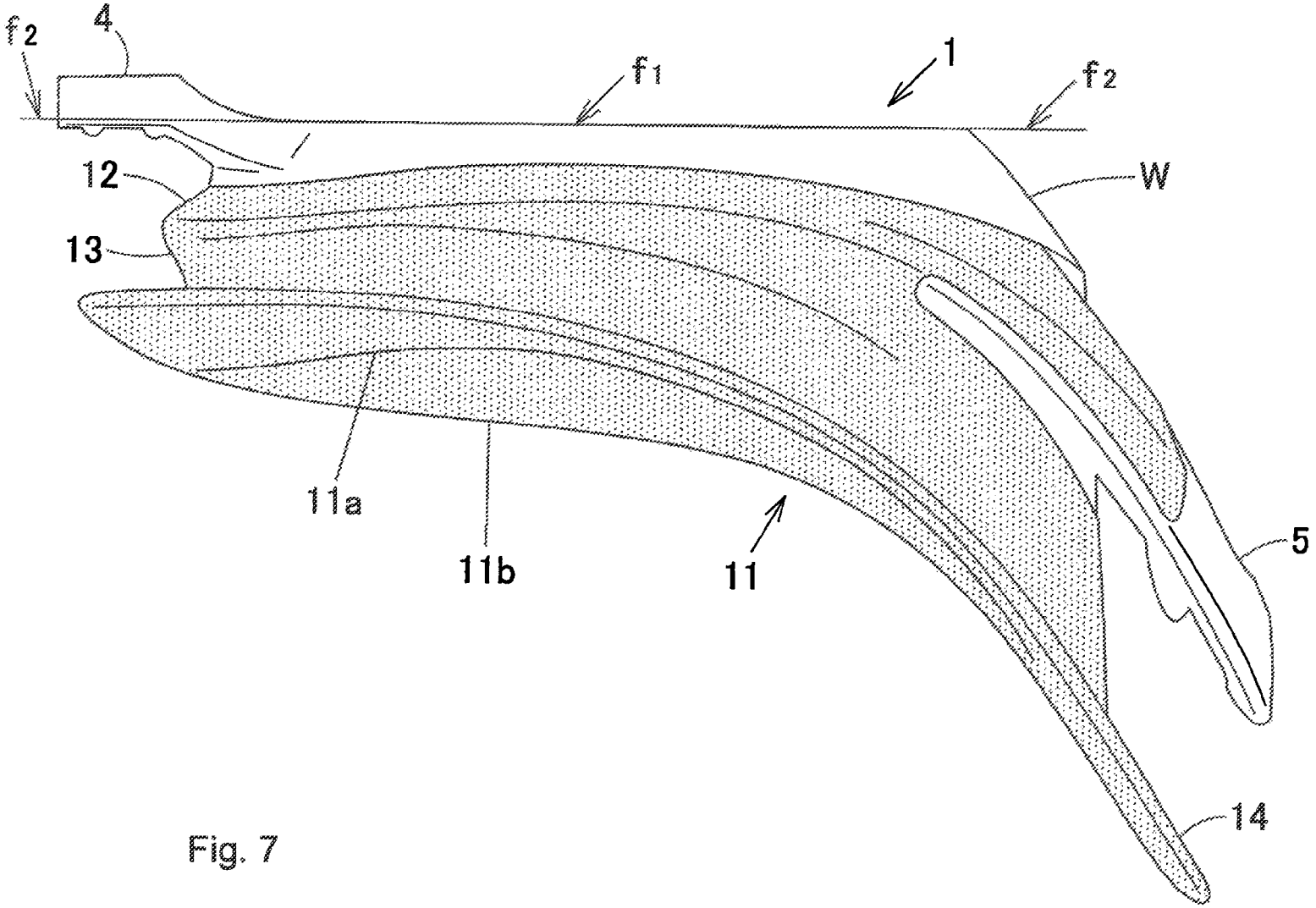
FIG. 7 is a plan view of the goggle body of the swimming goggles according to the present invention to which the face-contact pad is mounted.

Also, in the swimming goggles according to the present invention, an upper contact surface 11*a* and a lower contact surface 11*b* of the face-contact pad 11 mounted to the goggle body 1, the upper contact surface 11*a* and the lower contact surface 11*b* respectively being in contact with positions above and below the eye of the wearer, are asymmetrically formed as shown in FIGS. 6 and 7. An entire distance from the lens front surface f1 of the goggle body 1 and the extension surface f2 of the lens front surface f1 to the lower contact surface 11*b* is greater than an entire distance from the lens front surface f1 of the goggle body 1 and the extension surface f2 of the lens front surface f1 to the upper contact surface 11*a*.

Figure 5:
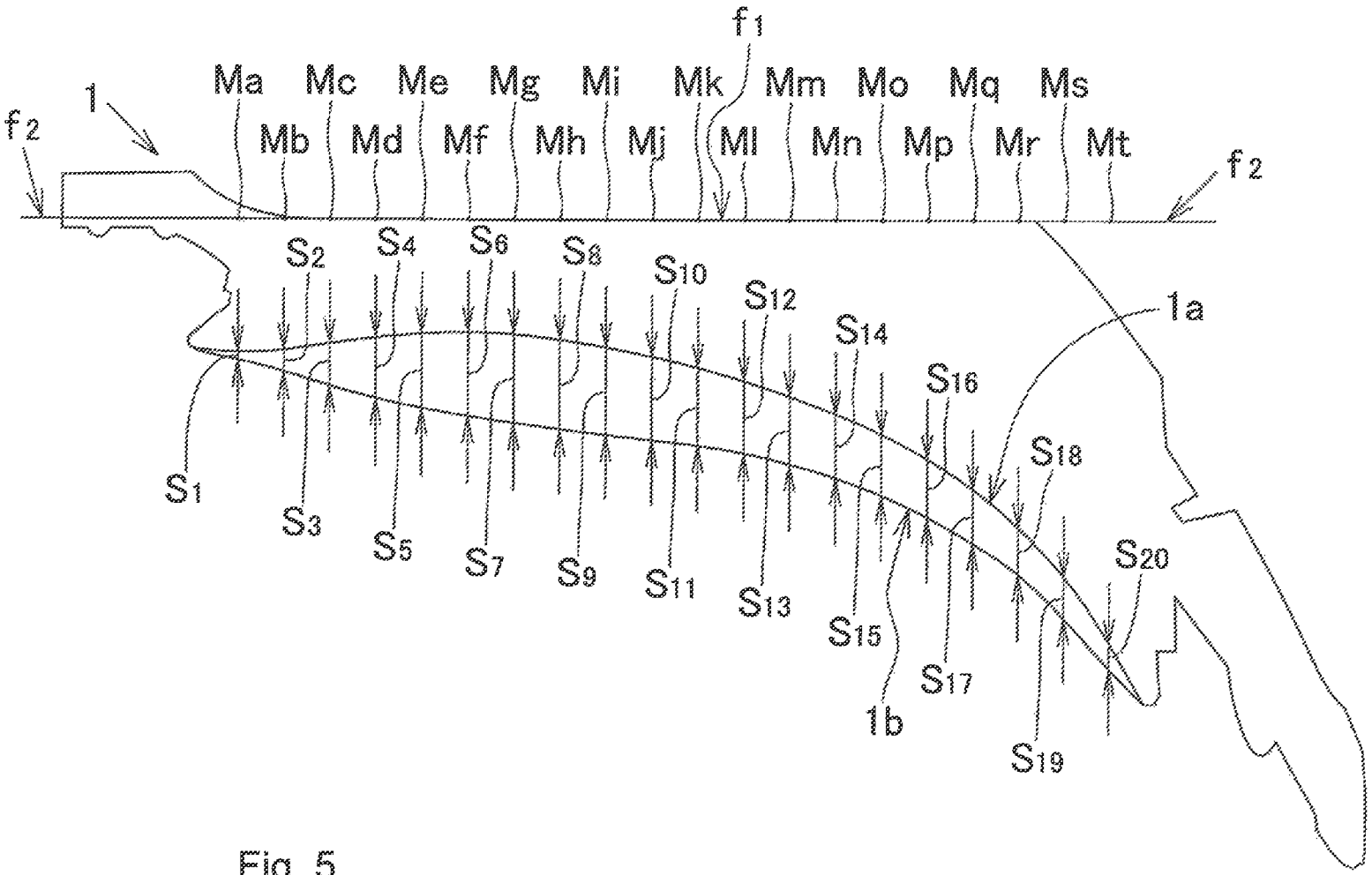
FIG. 5 is an explanatory view illustrating a distance between an upper connection surface and a lower connection surface of the goggle body of the swimming goggles according to the present invention.

In the swimming goggles according to the present invention, differences S1 to S20 between the distance from the lens front surface f1 of the goggle body 1 and the extension surface f2 of the lens front surface f1 to the upper connection surface 1*a* of the goggle body 1, and the distance from the lens front surface f1 of the goggle body 1 and the extension surface f2 of the lens front surface f1 to the lower connection surface 1*b* of the goggle body 1 at respective measurement positions Ma to Mt provided sequentially at equal intervals in a direction from an inner end portion to an outer end portion of the goggle body in the lens front surface f1 of the goggle body 1 and the extension surface f2 of the lens front surface f1 are set to 0.30 to 5.00 mm, and an average value thereof is set to 3.00 to 3.50 mm, preferably 3.25 mm as shown in FIG. 5.

Figure 8:
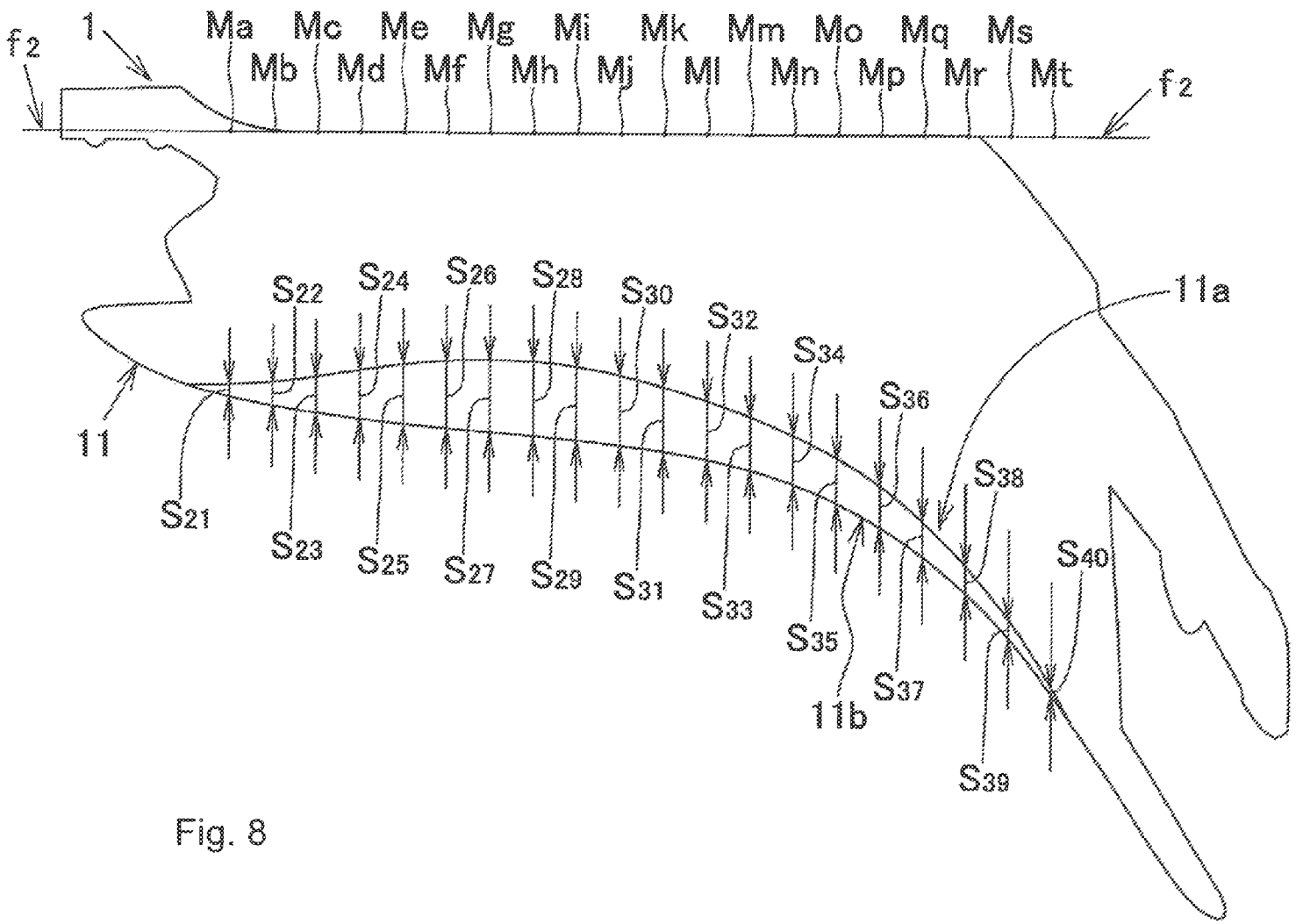
FIG. 8 is an explanatory view illustrating a distance between an upper contact surface and a lower contact surface of the face-contact pad of the swimming goggles according to the present invention.

Furthermore, in the swimming goggles according to the present invention, differences S21 to S40 between the distance from the lens front surface f1 of the goggle body 1 and the extension surface f2 of the lens front surface f1 to the upper contact surface 11*a* of the face-contact pad 11, and the distance from the lens front surface f1 of the goggle body 1 and the extension surface f2 of the lens front surface f1 to the lower contact surface 11*b* of the face-contact pad 11 at the respective measurement positions Ma to Mt provided sequentially at equal intervals in the direction from the inner end portion to the outer end portion of the goggle body in the lens front surface f1 of the goggle body 1 and the extension surface f2 of the lens front surface f1 are set to 0.30 to 5.00 mm, and an average value thereof is set to 3.00 to 3.50 mm, preferably 3.25 mm as shown in FIG. 8.

The value increases gradually from the difference S1 to S6. The largest value is obtained at the difference S7 or S8. The value decreases gradually from the difference S9 to S20. An average value of the differences S1 to S6 is set to 2.40 to 2.80 mm, preferably 2.62 mm. The difference S7 or S8 is set to 4.60 to 5.00 mm, preferably 4.82 mm. An average value of the differences S9 to S20 is set to 3.10 to 3.50 mm, preferably 3.31 mm.

The value increases gradually from the difference S21 to S26. The largest value is obtained at the difference S27 or S28. The value decreases gradually from the difference S29 to S40. An average value of the differences S21 to S26 is set to 2.40 to 2.80 mm, preferably 2.62 mm. The difference S27 or S28 is set to 4.60 to 5.00 mm, preferably 4.82 mm. An average value of the differences S29 to S40 is set to 3.10 to 3.50 mm, preferably 3.31 mm.

In the swimming goggles according to the present invention, concrete figures of the differences S1 to S20 are as follows. For example, the difference S1 is 0.30 mm, the difference S2 is 1.12 mm, the difference S3 is 2.26 mm, the difference S4 is 3.29 mm, the difference S5 is 4.10 mm, the difference S6 is 4.64 mm, the difference S7 is 4.84 mm, the difference S8 is 4.80 mm, the difference S9 is 4.65 mm, the difference S10 is 4.44 mm, the difference S11 is 4.20 mm, the difference S12 is 3.97 mm, the difference S13 is 3.75 mm, the difference S14 is 3.53 mm, the difference S15 is 3.31 mm, the difference S16 is 3.09 mm, the difference S17 is 2.85 mm, the difference S18 is 2.56 mm, the difference S19 is 2.09 mm, and the difference S20 is 1.29 mm. The figures are set based on measurement data on the contour at a portion between the eyebrow and the upper lid and a portion slightly below the lower lid of Japanese men in their twenties by the Research Institute of Human Engineering for Quality Life.

Although concrete figures of the differences S21 to S40 are not described here, the figures corresponding to the differences S1 to S20 can be employed, but not limited thereto.

That is, by setting the differences S1 to S20 and the differences S21 to S40 to the figures as described above, the swimming goggles according to the present invention can produce desired effects that a clear mark of the face-contact pad does not remain locally, a wearer does not feel uncomfortable when wearing the goggles, and water does not leak in the goggles even when a high water pressure is applied at the time of diving or the like. Setting the differences S21 to S40 to the figures as described above can provide the similar effects, regardless of setting the differences S1 to S20.

Figure 9:
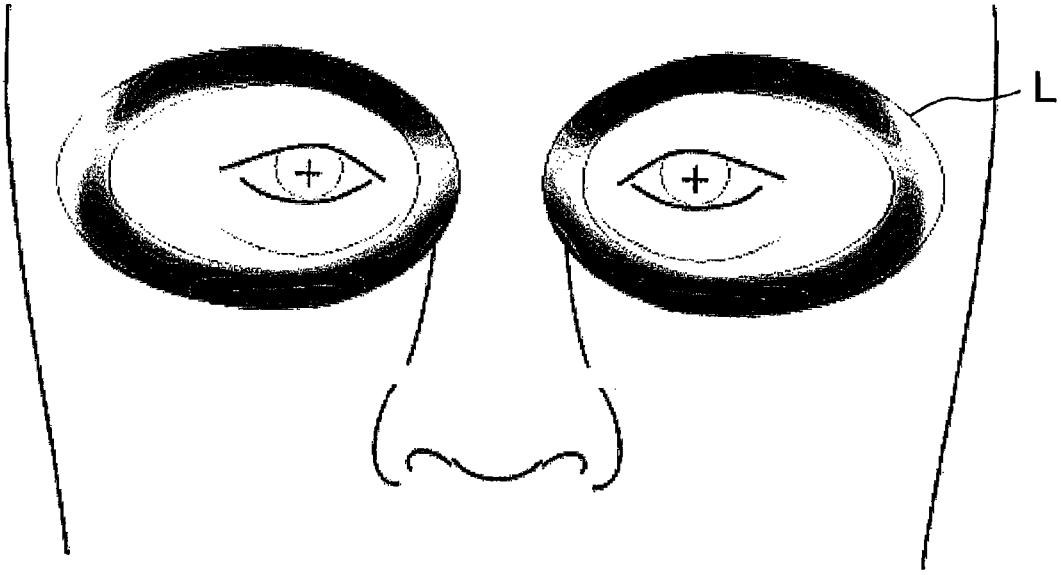
FIG. 9 is an explanatory view illustrating the distribution of a contact pressure of the face-contact pad of the swimming goggles according to the present invention on a portion around each eye of a wearer.
Figure 10:
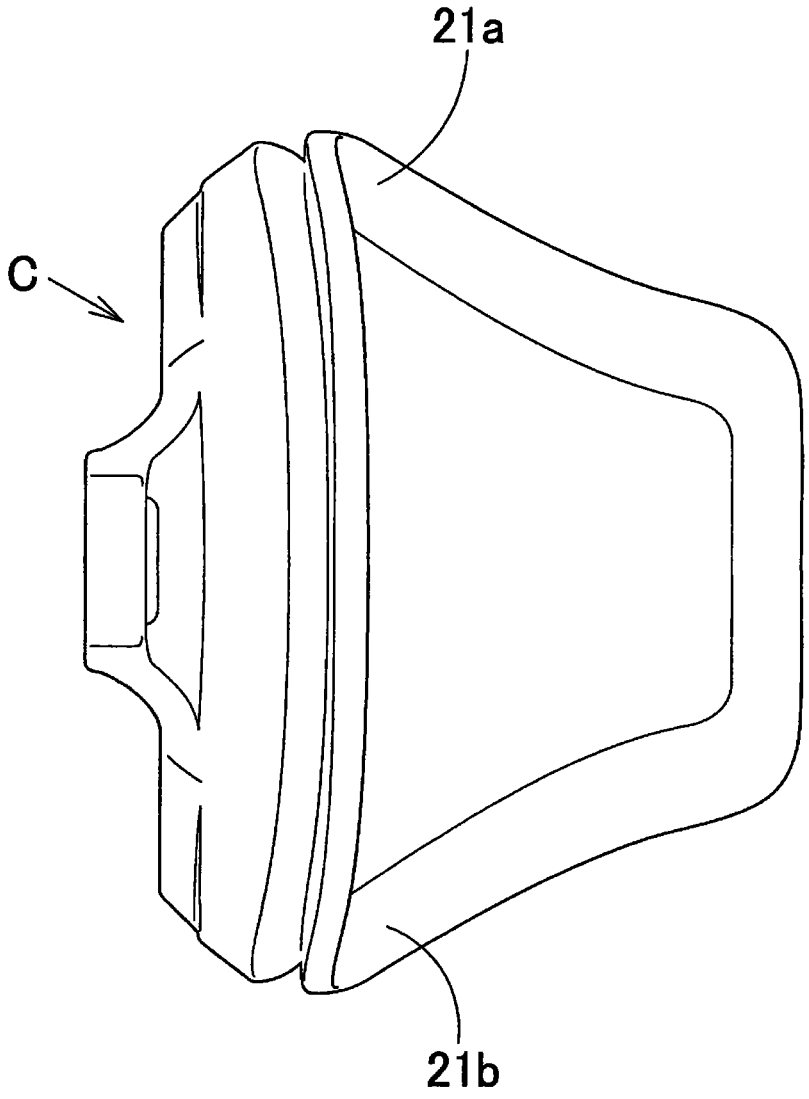
Prior Art Fig.10
FIG. 10 is a side view of an eyecup of conventional swimming goggles to which a face-contact pad is not mounted.
Figure 11:
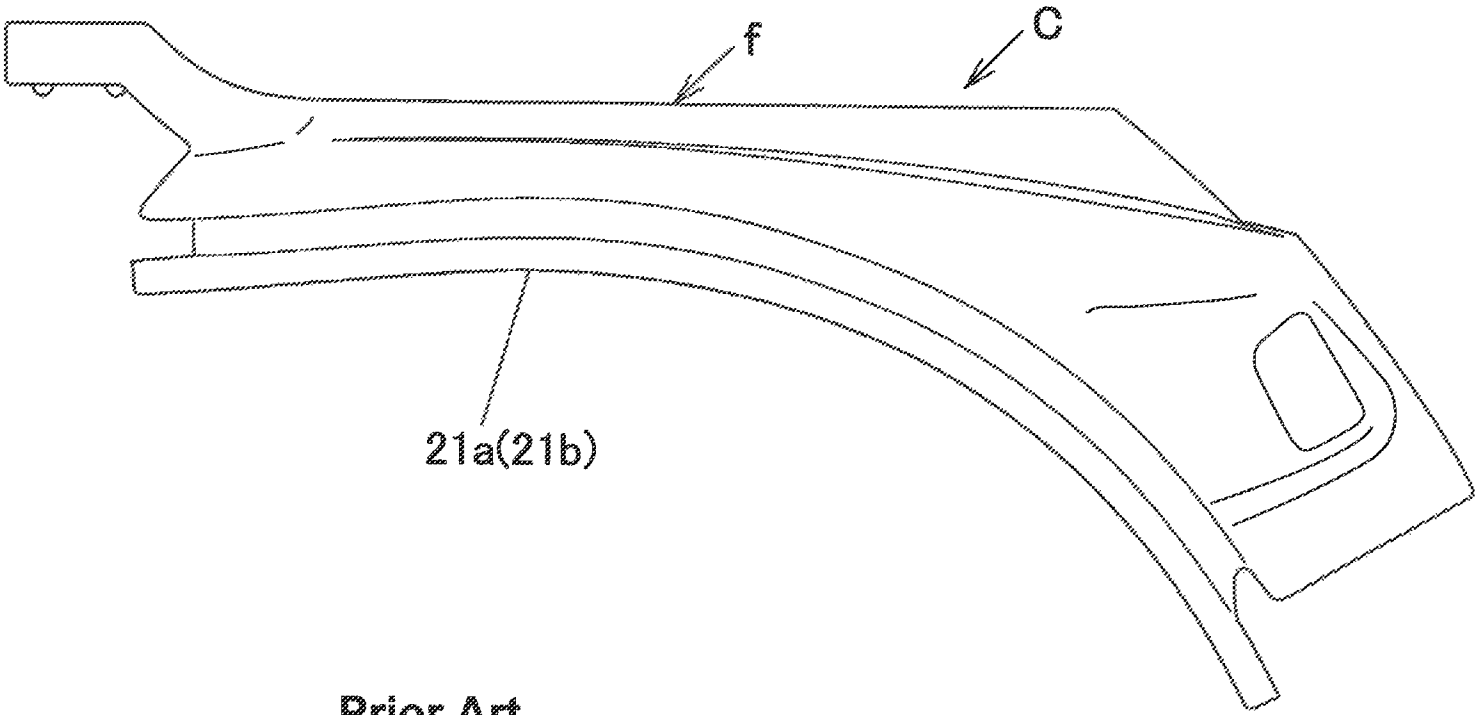
Prior Art Fig. 11
FIG. 11 is a plan view of the eyecup of the conventional swimming goggles to which the face-contact pad is not mounted.
Figure 12:
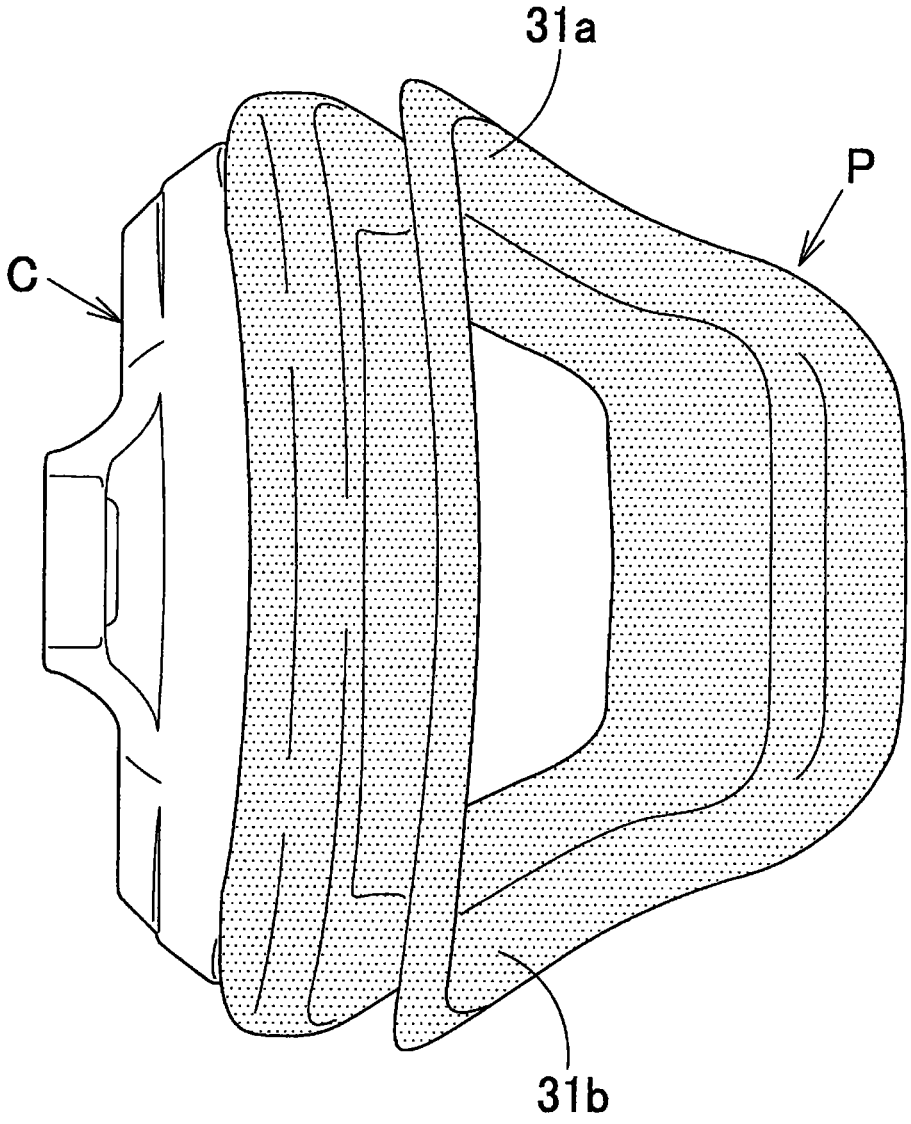
Prior Art Fig.12
FIG. 12 is a side view of the eyecup of the conventional swimming goggles to which the face-contact pad is mounted.
Figure 13:
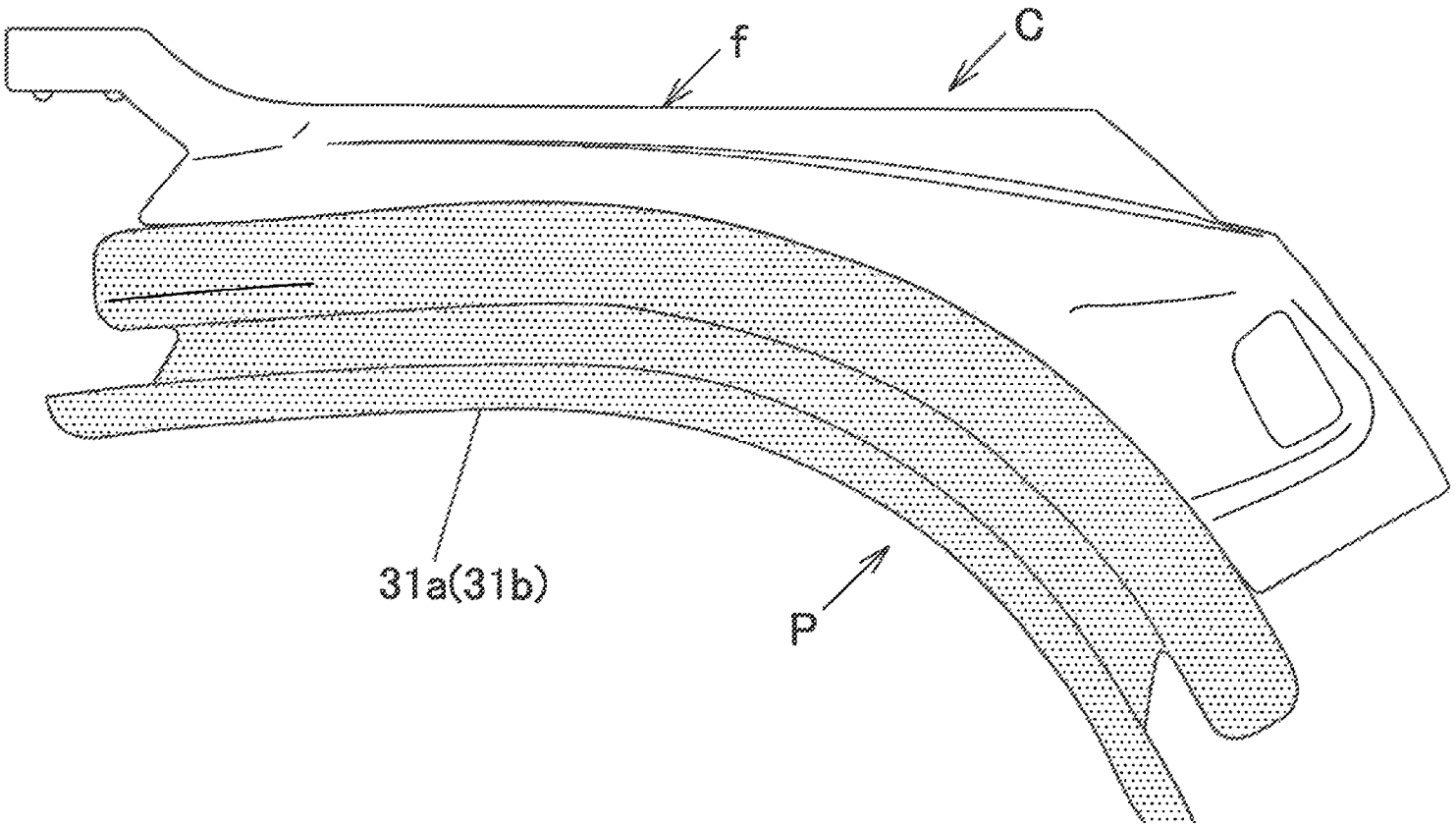
Prior Art Fig. 13
FIG. 13 is a plan view of the eyecup of the conventional swimming goggles to which the face-contact pad is mounted.
Figure 14:
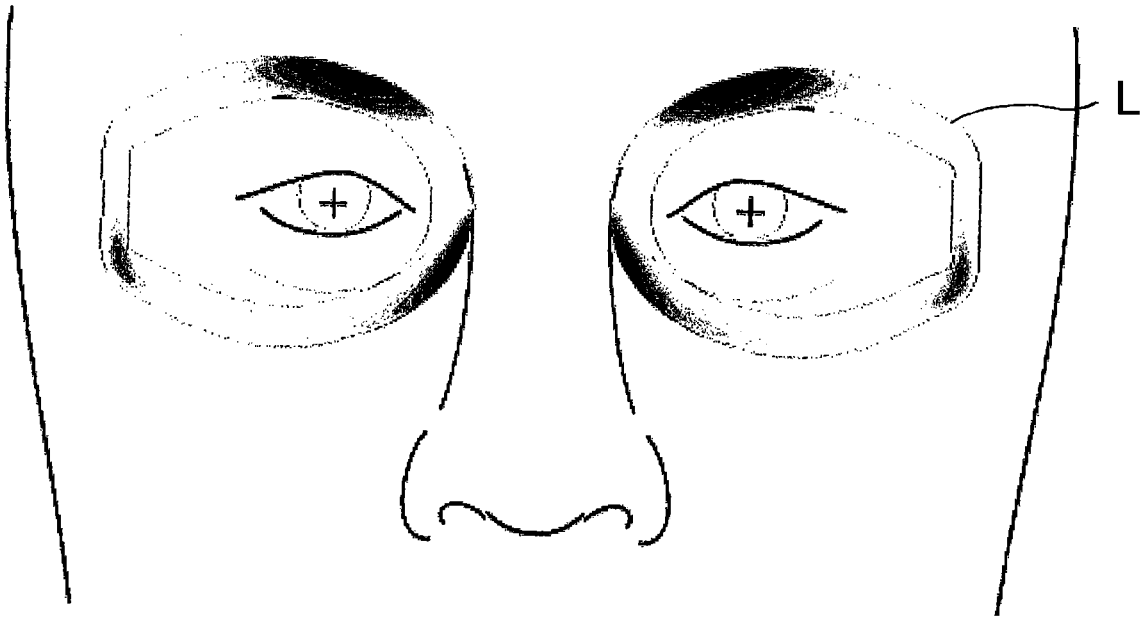
Prior Art Fig.14
FIG. 14 is an explanatory view illustrating the distribution of a contact pressure of the face-contact pad of the conventional swimming goggles on a portion around each eye of a wearer.

FIG. 9 is an explanatory view illustrating the distribution of a contact pressure of the face-contact pad of the swimming goggles according to the present invention on a portion around each eye of a wearer. FIG. 14 is an explanatory view illustrating the distribution of a contact pressure of a face-contact pad of conventional swimming goggles shown in FIGS. 12 and 13 on a portion around each eye of a wearer. The drawings are based on the measurement data by the Research Institute of Human Engineering for Quality Life.

An outline L in the drawings indicates a contact surface between the face-contact pad and the portion around the eye of the wearer. A color gradation of 3 to 5 stages shown within the outline L indicates the distribution of the contact pressure. A darker color represents a larger contact pressure.

According to FIG. 9, in the swimming goggles according to the present invention, the entire portion between the eyebrow and the upper lid, and the entire portion slightly below the lower lid are pressed by the face-contact pad in a balanced manner. Thus, the clear mark of the face-contact pad does not remain locally, and the wearer does not feel uncomfortable when wearing the goggles.

Meanwhile, in the conventional swimming goggles, the portion between the eyebrow and the upper lid, especially a portion close to the glabella between the eyebrow and the upper lid, and a portion close to the nose slightly below the lower lid are strongly pressed by the face-contact pad as shown in FIG. 14. The clear mark of the face-contact pad thereby remains locally in the portions. The wearer also feels uncomfortable when wearing the goggles.

Furthermore, according to FIG. 9, in the swimming goggles according to the present invention, the entire portion between the eyebrow and the upper lid, and the entire portion slightly below the lower lid are strongly pressed by the face-contact pad. Thus, even when a high water pressure is applied at the time of diving or the like, water does not leak in the goggles.

Meanwhile, as shown in FIG. 14, in the conventional swimming goggles, although the portion close to the glabella between the eyebrow and the upper lid and the portion close to the nose slightly below the lower lid are strongly pressed by the face-contact pad, a pressing force of the face-contact pad on another portion is correspondingly reduced. Thus, when a high water pressure is applied at the time of diving or the like, water may leak in the goggles from the portion.

What is claimed is:

1. Swimming goggles comprising:

a goggle body of eyecup shape having a lens front surface, a peripheral wall portion extending backward from a rim of the lens front surface, and a mounting flange;

a face-contact pad mounted to the mounting flange of the goggle body;

the face-contact pad having a face-contact portion including a laterally extending upper contact surface for contact above an eye of a wearer and a laterally extending lower contact surface for contact below the eye, the upper contact surface and the lower contact surface being asymmetrical such that a first distance from the lens front surface of the goggle body and an extension surface of the lens front surface to the lower contact surface is greater than a second distance from the lens front surface of the goggle body and the extension surface of the lens front surface to the upper contact surface by a difference that varies along a lateral direction, and an average value of the difference between the first distance and the second distance at respective measurement points provided sequentially at equal intervals in the lateral direction from an inner end portion to an outer end portion of the goggle body in the lens front surface of the goggle body and the extension surface of the lens front surface is 3.00 to 3.50 mm.

2. Swimming goggles according to claim 1, wherein the goggle body has an upper connection surface in contact with an upper mounting surface of the face-contact pad, and a lower connection surface in contact with a lower mounting surface of the face-contact pad; and wherein the upper connection surface and the lower connection surface of the goggle body are asymmetrically formed, and a third distance from the lens front surface of the goggle body and the extension surface of the lens front surface to the lower connection surface of the goggle body is greater than a fourth distance from the lens front surface of the goggle body and the extension surface of the lens front surface to the upper connection surface of the goggle body.

3. The swimming goggles according to claim 2, wherein an average value of differences between the third distance and the fourth distance at respective measurement positions provided sequentially at equal intervals in the lateral direction from the inner end portion to the outer end portion of the goggle body in the lens front surface of the goggle body and the extension surface of the lens front surface is 3.00 to 3.50 mm.

4. The swimming goggles according to claim 3, wherein the measurement positions comprise twenty measurement positions, and the value of the difference between the third distance and the fourth distance increases gradually from an initial to a sixth of the twenty measurement positions, a largest value is obtained at a seventh or an eighth of the twenty measurement positions, and the value decreases gradually from a ninth to a final of the twenty measurement positions.

5. The swimming goggles according to claim 4, wherein an average value of the difference from the initial to the sixth of the twenty measurement positions is 2.40 to 2.80 mm, the value at the seventh or the eighth of the twenty measurement positions is 4.60 to 5.00 mm, and an average value of the difference from the ninth to the final of the twenty measurement positions is 3.10 to 3.50 mm.

6. The swimming goggles according to claim 1, wherein the measurement points comprise twenty measurement points, and a value of the difference increases gradually from a first to a sixth of the twenty measurement points, a largest value is obtained at a seventh or an eighth of the twenty measurement points, and the value decreases gradually from a ninth to a last of the twenty measurement points.

7. The swimming goggles according to claim 6, wherein an average value of the difference from the first to the sixth of the twenty measurement points is 2.40 to 2.80 mm, the difference at the seventh or the eighth of the twenty measurement points is 4.60 to 5.00 mm, and an average value of the difference from the ninth to the last of the twenty measurement points is 3.10 to 3.50 mm.

8. The swimming goggles according to claim 1, wherein the measurement points comprise twenty measurement points, and an average value of the differences from a first to a sixth of the twenty measurement points is 2.40 to 2.80 mm, the value of the difference at a seventh or an eighth of the twenty measurement points is 4.60 to 5.00 mm, and an average value of the difference from a ninth to a last of the twenty measurement points is 3.10 to 3.50 mm.

9. The swimming goggles according to claim 1, further comprising a second goggle body mounting a second said face-contact pad, a flexible coupling body joining inner end portions of the goggle body and the second goggle body, and a fastening band joining outer end portions of the goggle body and the second goggle body.

* * * * *

UNITED STATES PATENT AND TRADEMARK OFFICE

CERTIFICATE OF CORRECTION

PATENT NO. : 8,650,667 B2
APPLICATION NO. : 12/905784
DATED : February 18, 2014
INVENTOR(S) : Tominaga et al.

It is certified that error appears in the above-identified patent and that said Letters Patent is hereby corrected as shown below:

Title Page:

Item (73): Delete "Yamamoto Kagaku Co., Ltd." and insert -- Yamamoto Kogaku Co., Ltd. --

Signed and Sealed this
Twenty-seventh Day of May, 2014

Michelle K. Lee

Michelle K. Lee
*Deputy Director of the United States Patent and Trademark Office*